US009416605B2

(12) United States Patent
Aldén

(10) Patent No.: US 9,416,605 B2
(45) Date of Patent: Aug. 16, 2016

(54) METHOD AND SYSTEM FOR DETERMINING A VARIATION IN A FLUSHING MEDIUM FLOW AND ROCK DRILLING APPARATUS

(75) Inventor: Erik Aldén, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 542 days.

(21) Appl. No.: 13/261,586

(22) PCT Filed: Aug. 25, 2011

(86) PCT No.: PCT/SE2011/051026

§ 371 (c)(1),
(2), (4) Date: Feb. 4, 2013

(87) PCT Pub. No.: WO2012/026874

PCT Pub. Date: Mar. 1, 2012

(65) Prior Publication Data

US 2013/0167627 A1 Jul. 4, 2013

(30) Foreign Application Priority Data

Aug. 26, 2010 (SE) ..... 1000870

(51) Int. Cl.
*E21B 21/08* (2006.01)
*E21B 21/16* (2006.01)

(52) U.S. Cl.
CPC ..... *E21B 21/08* (2013.01); *E21B 21/16* (2013.01)

(58) Field of Classification Search
CPC ..... E21B 21/08; E21B 21/16
See application file for complete search history.

(56) References Cited

U.S. PATENT DOCUMENTS

| | | | | |
|---|---|---|---|---|
| 6,216,800 | B1 | 4/2001 | Wilson et al. | |
| 8,727,037 | B1 * | 5/2014 | Mouton | 175/25 |
| 2007/0246262 | A1 | 10/2007 | Brookover | |
| 2008/0060846 | A1 * | 3/2008 | Belcher et al. | 175/25 |
| 2009/0071715 | A1 | 3/2009 | Sormunen et al. | |

FOREIGN PATENT DOCUMENTS

| | | |
|---|---|---|
| DE | 3229487 | 2/1984 |
| WO | WO2009/139743 | 11/2009 |
| WO | WO2009/139825 | 11/2009 |

* cited by examiner

*Primary Examiner* — Brad Harcourt
(74) *Attorney, Agent, or Firm* — Mark P. Stone

(57) ABSTRACT

The present invention relates to a method for determining a variation of a flushing medium flow at a rock drilling apparatus, where a compressor (8;301) discharges a flow of pressurized gas, where said gas flow at least partially is used as flushing medium during drilling with a tool (3), wherein, during drilling, said flushing medium is led to said tool (3) for flushing away drilling remnants. The method includes to determine a rate of a pressure variation of said flushing medium, and generating a signal when said determined rate exceeds a first value. The invention also relates to a system and a rock drilling apparatus.

20 Claims, 4 Drawing Sheets

METHOD AND SYSTEM FOR DETERMINING A VARIATION IN A FLUSHING MEDIUM FLOW AND ROCK DRILLING APPARATUS

FIELD OF THE INVENTION

The present invention relates to methods and systems for determining flushing medium flows, and in particular to a method for controlling a variation in a flushing medium flow during rock drilling. The invention also relates to system and a rock drilling apparatus.

BACKGROUND OF THE INVENTION

Rock drilling apparatuses may be used in a number of areas of application. For example, rock drilling apparatuses may be used in tunnelling, underground mining, rock reinforcement, raise boring, and for drilling of blast holes, grout holes and holes for installing rock bolts, etc.

A drill tool such as, for example, a drill bit is often used during drilling, the drill bit being connected to a drilling machine, in general by means of a drill string. The drilling can be accomplished in various ways, e.g. as rotational drilling where the drill tool is pushed towards the rock at high pressure and then crushes the rock by means of rotation force and applied pressure.

Percussive drilling machines can also be used, where, for example, a piston strikes the drill string to transfer percussive pulses to the drill tool via the drill string and then further on to the rock. Percussive drilling is often combined with a rotation of the drill string in order to obtain a drilling where the buttons of the drill bit strikes fresh rock at each stroke, thereby increasing the efficiency of the drilling.

During drilling the drill tool can be pressed against the rock by means of a feed force to ensure that as much impact energy as possible from the hammer piston is transmitted to the rock.

The above drilling principles have in common that the rock is crushed during drilling, whereby drilling remnants, so called drill cuttings, are formed and which must be evacuated from the drill hole in order to perform the drilling in an efficient manner.

This is in general performed with the aid of a flushing medium, such as, for example, compressed air, flushing air, which is led through a channel in the drill string for release through flushing air holes in the drill bit to thereafter bring drill cuttings on the way up through the hole.

During rock drilling, such as, but not limited to, top hammer drilling, there is a risk that the flushing air holes in the drill bit gets clogged by drilling remnants during drilling, and thereby stops the flushing air from flushing away the drilling remnants. If the flushing air is stopped from flushing the hole clean from drilling remnants, the drilling remnants will start to build up on the drill bit, which leads to deteriorated drilling and the drill bit in a worst case getting completely stuck.

Consequently, systems for detecting and stopping such situations from arising are required, e.g. by generating a warning signal if the flushing air flow falls below a too low level, whereby suitable actions can be taken.

Today, a so called venturi tube, which is arranged between compressor and drill string, is, in general, used at drilling rigs where a flushing medium consisting of compressed air is used. A pressure switch is measuring the differential pressure over the venturi tube, where the pressure difference over the tube increases with an increasing flow through the tube. The pressure switch is set such that a signal is generated when the pressure difference over the venturi tube, and thereby also the flushing air flow, is lower than a set level.

This solution, however, has several disadvantages. Apart from the solution being relatively expensive, sensitive and difficult to set in a correct manner, the pressure switch consists of an analogue sensor that cannot be controlled, e.g. via software. Due to difficulties in setting the pressure switch, which in general is carried out manually by means of e.g. adjuster screws, it is also not possible to adapt the pressure level difference at which the pressure switch will generate a signal to different operating points, which means that the pressure switch can function better at certain conditions occurring during rock drilling as compared to other situations with other prevailing conditions.

Consequently, there exists a need for an improved method for determining variations of the flushing medium flow during rock drilling.

SUMMARY OF THE INVENTION

It is an object of the present invention to provide a method for determining a variation of a flushing air flow at a rock drilling apparatus that solves the above problem. This object is achieved by means of a method according to claim 1.

The present invention relates to a method for determining a variation of a flushing medium flow at a rock drilling apparatus, where a compressor discharges a flow of pressurized gas, where said gas flow at least partially is used as flushing medium during drilling with a tool, wherein, during drilling, said flushing medium is led to said tool for flushing away drilling remnants. The method includes determining a rate of a pressure variation of said flushing medium, and generating a signal when said determined rate exceeds a first value.

The present invention has the advantage that a method for determining a flushing medium flow variation, and in particular a flushing medium flow reduction, is obtained, which is independent from the actual working pressure that is prevailing in the flushing medium system/circuit.

In general, the actual working pressure of the flushing medium system can vary considerably during ongoing drilling. For example, only the portion of the flushing medium pressure that relates to the flush resistance up to the drill bit can be more than twice as big or even bigger, at the end of the drilling of a hole, when a plurality of drill rods are joined together in the drill string, in comparison to the beginning of the drilling when only one drill rod is used.

By determining the rate at which a pressure variation occurs in the flushing medium circuit according to the present invention, this rate can be used as a representation of the difference between the flow that is provided to the flushing medium circuit and the flow that actually flows out through the drill bit, whereby a variation can be determined independent from current working pressure. The pressure variation can, for example, be determined by means of a pressure sensor, whereby two or more consecutive pressure determinations can be performed to determine said pressure variation.

The invention also has the advantage that a determination/detection of a flow variation can occur before the pressure in the system has risen to, e.g. a maximum pressure level, which in turn has as result that the control system and/or operator of the rock drilling apparatus can be made aware of the approaching problem earlier than what has previously been possible. Consequently, it is also made possible to take actions for solving problems with ongoing clogging at an earlier stage.

The present invention is particularly suitable at systems where a flow controlled compressor is used to generate said flushing medium flow. The working pressure at flow controlled compressors, in general, differs substantially (the working pressure is lower) from the maximum allowed working pressure of the compressor/flushing air circuit. During such situations, the present invention provides a solution that can generate a warning signal faster as compared to the prior art, where the working pressure at first must increase to a maximum allowed pressure before a detection of a reduction in flushing air flow occurs.

DETAILED DESCRIPTION OF EXEMPLARY EMBODIMENTS

Figure 1:
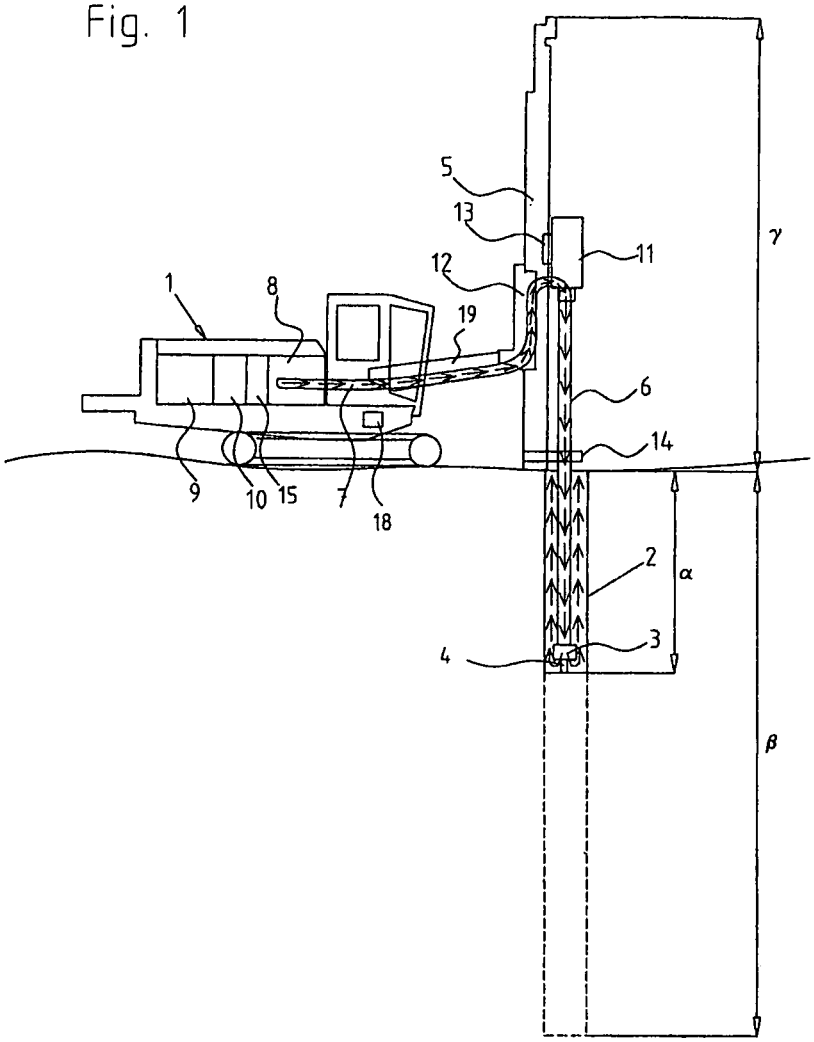
FIG. 1 discloses a rock drilling apparatus at which the present invention advantageously can be utilized.

FIG. 1 shows a rock drilling apparatus according to a first exemplary embodiment of the present invention for which an inventive monitoring of the flushing air flow will be described.

The rock drilling apparatus shown in FIG. 1 includes a drilling rig 1, in this example a surface drilling rig, which carries a drilling machine in the form of a top hammer drilling machine 11.

The drilling rig 1 is shown in use, drilling a hole 2 in rock, which starts at the surface and where the drilling at present is at a depth $\alpha$. The hole is intended to result in a hole having the depth $\beta$, which, depending on area of use, can vary to large extent from hole to hole and/or from area of use to area of use. The finished hole is indicated by dashed lines. (The shown relationship between drilling rig height and hole depth is not intended to be proportional in any way. The total height $\gamma$ of the drilling rig can, for example be 10 meters, while the hole depth $\beta$ can be both less than and considerably larger than 10 meters, e.g. 20 meters, 30 meters, 40 meters or more).

The top hammer drilling machine 11 is, via a drill cradle 13, mounted on a feed beam 5. The feed beam 5, in turn, is attached to a boom 19 via a feed beam holder 12. The top hammer drilling machine 11 provides, via a drill string 6 being supported by a drill string support 14, percussive action onto a drill tool in the form of a drill bit 3, which transfer shock wave energy from the top hammer drilling machine 11 onto the rock. For practical reasons (except possibly for very short holes) the drill string 6 does not consist of a drill rod in one piece but consists, in general, of a number of drill rods. When the drilling has progressed a distance corresponding to a drill rod length a new drill rod is threaded together with the one or more drill rods that already has been threaded together, whereby drilling can progress for another drill rod length before a new drill rod is threaded together with existing drill rods.

The top hammer drilling machine 11 is of hydraulic type, and is power supplied by means of a hydraulic pump 10 via hoses (not shown) in a conventional manner. The hydraulic pump, in turn, is driven by a power source e.g. in the form of a combustion engine 9 such as a diesel engine (alternatively the power source 9 can consist of an electric motor).

A flushing medium, in the present example, compressed air, flushing air, is used to flush the drill holes clean from the drill cuttings that are formed during drilling so that drilling can be performed in an efficient manner (the flushing medium can also include additives. For example, water, with or without additive can be added to the flushing air).

In the disclosed rock drilling apparatus the flushing air is led from a compressor 8 via a tank. In the present example is used an oil lubricated compressor, whereby the tank constitutes a separator tank (see description in connection to FIGS. 2-3 below). In one embodiment the compressor is not an oil lubricated compressor, whereby another kind of tank can be used. Alternatively, no tank at all is used. The flushing air is led from the tank via hoses to the drill string to be led through the drill rods, which consist of thick-walled pipes, e.g. made from steel. A channel through the drill string formed in or through the rod walls in the longitudinal direction is used to feed flushing air from the drill rig 1 through the drill string 6 for release through flushing air holes in the drill bit to thereafter bring drill cuttings on the way up through the hole.

The flushing air flushes the drill cuttings upwards through and out of the hole 2 in the space between drill rod and drill wall, as is indicated by the upwardly directed arrows in FIG. 1 (according to an alternative embodiment the drill cuttings are flushed out from the hole through a channel in the drill string, whereby the flushing medium is led through the hole in another channel formed in the drill string).

Irrespective of flow path it is required, in order for the drill cuttings to follow the flushing air up through the hole, that the flushing air reaches at least a certain flow rate. This minimum flow rate that is required for the drill cuttings to follow the flushing air up through the hole and not remain in the hole with clogging problems as a consequence, depends primarily on the size, form and density of the drill cuttings. It is important that the flow rate is sufficiently high for the drill cuttings to follow the air flow to the surface, since a flow rate that is too low can deteriorate drilling performance, and at worst lead to the drilling getting stuck. At the same time it is important that the rate of the air flow is not unnecessarily high, since a too high flow leads to an increased energy consumption and also to increased wear of components due to the blasting effect the drill string is subjected to by the drill cuttings being carried by the flushing air up through the hole.

The drilling rig also includes a control unit 18, which consists part of the drilling rig control system and which can be used to control various functions, such as, for example, monitoring the flushing air flow according to the present invention according to the below.

The compressor 8 is driven by the combustion engine 9, and according to the present example a screw compressor is used to press the flushing air through the channel in the drill strings down to the drill bit 3. A screw compressor consists of a compressor having a fixed displacement. In the disclosed embodiment the compressor 8 is directly connected to the combustion engine, which means that a variation in combustion engine speed directly will be reflected by a corresponding variation in the rotation speed of the compressor 8. According to an alternative embodiment the compressor is connected to the power source via some kind of suitable gearing. According to the disclosed embodiment the compressor is flow controlled, i.e. the compressor is controlled in such a manner that a controlled flow is discharged independent from the pressure that the compressor flow gives rise to in the flushing air circuit after the compressor for as long as the maximum pressure of the system has not been reached.

The flow from a compressor with fixed displacement can, in principle, be controlled according to two principles, where one consists of a control of the rotation speed of the compressor. The flow discharged by a compressor having a fixed displacement is directly proportional to the rotation speed of the compressor, and in situation when the power source of the compressor (in this case the combustion engine 9) can be freely speed controlled the flow discharged by the compressor can also be controlled to an arbitrary level between 0 and 100% of the capacity of the compressor solely by means of controlling the rotation speed.

The compressor and/or perhaps primarily the power source can, however, have a minimum rotation speed, e.g. due to the fact that the combustion engine must keep at least an idling speed in order to at all be running, whereby the practically possible lower limit for speed control many times is a certain minimum speed, which also imposes a restriction on how low flow the compressor can discharge by means of speed control only. There are also often other consumers connected to the power source, such as the said hydraulic pumps 10, 15, which, in order to obtain enough power, can require a higher combustion engine speed than at present is required by the compressor to discharge a desired flow. According to one embodiment, therefore, the compressor is controlled in such a manner that it discharges the lowest possible flow for as long as this flow equals or exceeds a desired flow. The flow of the compressor can also be controlled by controlling the inlet valve of the compressor. By controlling the negative pressure in the compressor inlet in a controlled and desired manner by means of the inlet valve the flow discharged by the compressor can be controlled to precisely a desired flow. In an alternative embodiment, therefore, the compressor is controlled according to this second principle.

The control of the flow of the compressor can, for example, also be arranged to be controlled according to the method described in the parallel application "METHOD AND SYSTEM FOR CONTROLLING A COMPRESSOR AT A ROCK DRILLING APPARATUS", published as WO 2012/026875 A1 on Mar. 1, 2012, having the same inventor and filing date as the present application.

According to the method disclosed in the said application it is shown a solution where the compressor works according to a first mode and a second mode, respectively, and wherein in said first mode the flow discharged by the compressor is arranged to be controlled by controlling the speed of said compressor, and wherein in said second mode the flow discharged by the compressor is arranged to be controlled by controlling the air flow at the inlet of the compressor. Consequently the rotation speed demand of the compressor can be arranged to be determined according to the method described in said application.

A determination of the flow that the compressor is to discharge can be determined by the control unit 18 and be based on one or more parameters. For example, a determination of flushing air flow can be based on the current depth of the drillhole. The flow of the compressor can also, fully or partly, be based on hole dimension, drill rod dimension, percussion mechanism power of the drilling machine (percussion pressure and/or percussion frequency) so that, irrespective of the percussion power, it can be ensured at all times that the flow is adapted to the drill cuttings that are generated during drilling.

The flushing air flow can, of course, also be controlled independent from the percussion pressure. For example, the nature of the rock can be taken into consideration, whereby the flushing air flow can be controlled at least partly in dependence of the nature of the rock in which drilling is carried out.

Control of the flow discharged by the compressor can also be based on other parameters.

Figure 3:
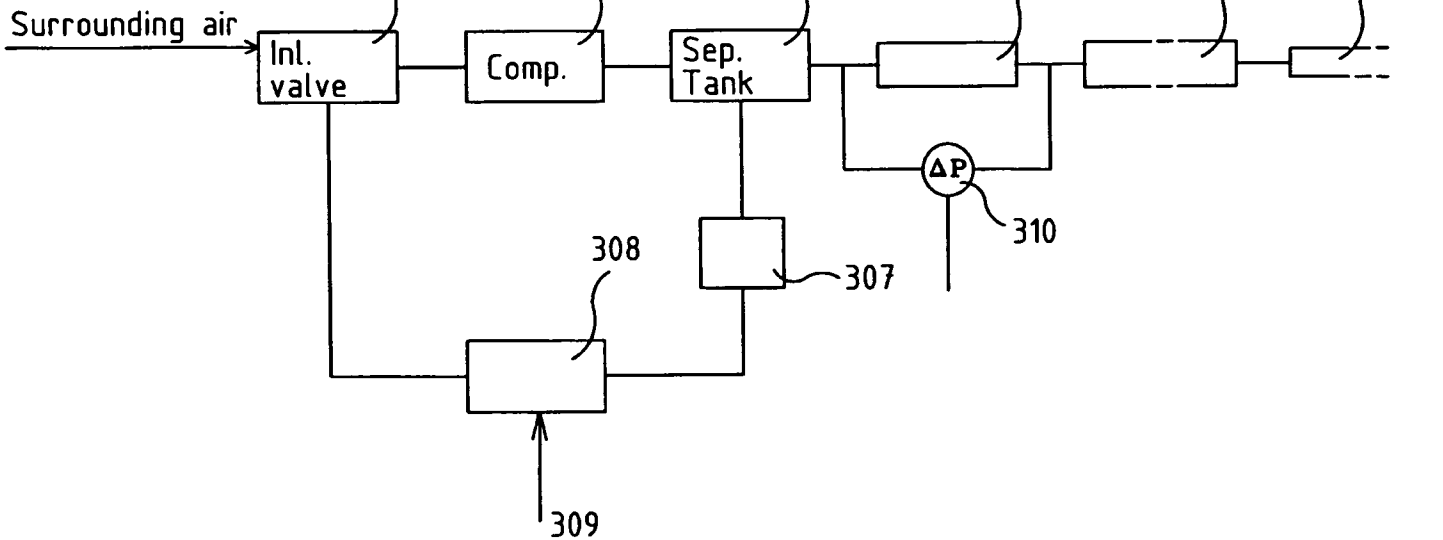
FIG. 3 PRIOR ART
FIG. 3 discloses a system for determining a variation in a flushing air flow according to prior art.

As was mentioned, a venturi tube is used according to the prior art to detect a flow variation in the flushing air circuit. For the sake of clarity FIG. 3 shows an example of a system for detecting problems with flushing air flow according to the prior art. The system includes a compressor 301 for generation of pressurized air/flushing air. The air being compressed is taken from the compressor surroundings, and is provided to the compressor 301 by means of an inlet valve 302. The pressurized air is led to a compressor tank/separator tank 303, where the oil being added in a conventional manner during compression is separated from the pressurized air to be reused as lubrication when compressing air.

The pressurized air is then led, via a venturi tube 304 and hoses 305 to the drill string 306 to be released in the opposite and of the drill string through holes in the drill bit for evacuation of drill cuttings from the drill hole.

Venturi tubes are well-known and consist, in principle, of a tube with a tapering from both ends towards the middle, whereby the tube thus has a smaller diameter in the middle in comparison to the ends of the tube. When the cross-sectional area of the tube is reducing, the flow rate velocity is increasing which, since the energy contained in the flow is substantially constant, has the result that the pressure is decreasing according to known equations.

By measuring the pressure before and in the middle of the tapering by means of a differential pressure meter 310 a pressure difference can be determined, where the pressure difference will depend on the flow. This pressure difference is then used to determine variations in the flow. Venturi tubes are well described in the prior art and are therefore not described further herein.

Further, a pressure meter 307 is arranged to measure the pressure in the compressor tank 303 (or at any other suitable localisation on the high pressure side of the compressor) and provides a regulator 308 with signals from the pressure meter 307. The pressure meter 307 is an analogue pressure meter, likewise the regulator 308 is an analogue regulator. The regulator 308 controls the pressure discharged by the compressor 301 in relation to reference pressure 309. The reference pressure is, in general, set by means of, for example, a handle that is maneuvered manually. The handle can, for example, be factory set in such a manner that the reference pressure corresponds to the maximum pressure that is allowed in the system. The maximum pressure is in general determined to a level that does not result in a risk of damages on components due to a too high pressure level.

The reference pressure 309 can be varied by means of said handle. The operator of the drilling rig can, for example, lower the reference pressure at situations where the operator with certainty knows that the drilling will not require the maximum capacity that the system can deliver. Many times, however, the factory set setting is left completely untouched.

The regulator 308 controls the working pressure of the compressor 301 by means of a mechanical control of the inlet valve 302. If the working pressure of the compressor 301 is lower than the reference pressure 309, the opening against the inlet of the compressor 301 is made larger by means of the inlet valve 302. If, on the other hand, the working pressure of the compressor is higher than the set reference pressure 309, the opening towards the compressor inlet is made smaller by means of the inlet valve 302. By continuously controlling the extent to which the inlet valve is open the working pressure of the compressor can consequently be continuously controlled.

Consequently, this means that when the compressor of the compressor tank 303 equals the reference pressure the inlet valve will be completely closed to open again if the pressure in the compressor tank falls below the reference pressure. In other words, the resulting flushing air flow (the flow out from the compressor tank) can, for any given pressure in the compressor tank, be 0-100% of the maximum flow that the compressor can deliver. If the flushing air holes in the drill bit are clogged such that the flushing air cannot pass the pressure in the compressor tank will consequently be controlled to the reference pressure 309, but the flow will be reduced all the way down to zero.

Consequently, since it is difficult to determine the flow at this kind of control, the differential pressure meter 310 is used to measure the pressure difference over the venturi tube 304. When the flow is zero through the venturi tube, the pressure difference over the tube will also be zero, while the pressure difference over the tube will be highest when the flow is highest. By setting a limit value for the differential pressure meter 310 to a level that corresponds to a flow where the drill bit is considered to be clogged or about to be clogged, a warning signal can be generated when the limit value is reached and the operator of the rock drilling apparatus can be made aware of the problem.

According to the above, a problem with this kind of solution, however, is that the pressure guard is difficult to set (it is in general set by means of adjuster screws), for which reason the pressure guard is set at the beginning of the drilling or in factory to any suitable value that then is maintained during drilling and consequently is not changed as new drill rods are added to the drill string.

Another problem of this kind of solution is that the warning signal will be generated only when the pressure in the volume that is represented by hoses and drill strings downstream the venturi tube has risen to the reference pressure, since the flow through the venturi tube will be consumed for this pressure build-up for as long as the reference pressure level has not been reached. Consequently, there will still be a flushing air flow through the venturi tube even though the drill bit can be completely clogged. This pressure build-up can take different amounts of time, where the time will depend on the volume of the system downstream the venturi tube, as well as current pressure in the system when the clogging occurs. The pressure build-up results in a delay before the warning signal is generated with the result that the clogging situation/situation where the drill is getting stuck will get worse from the time the clogging occurs until the warning signal is generated.

The problem of the solution shown in FIG. 3 gets even greater in the case the compressor, instead of being pressure controlled, is controlled towards a desired flow according to the above since the working pressure of the compressor at such a solution is, in general, lower (the flow that is actually required is often lower than the flow that is obtained during pressure control according to the above) and also that the compressor flow often is lower (at the solution shown in FIG. 3 the compressor flow will be at a maximum for as long as the pressure of the compressor tank is lower than the reference pressure), which means that the pressure build-up in the volume downstream the venturi tube will take even longer time with an even longer delay before the warning signal is generated, as result.

Figure 2:
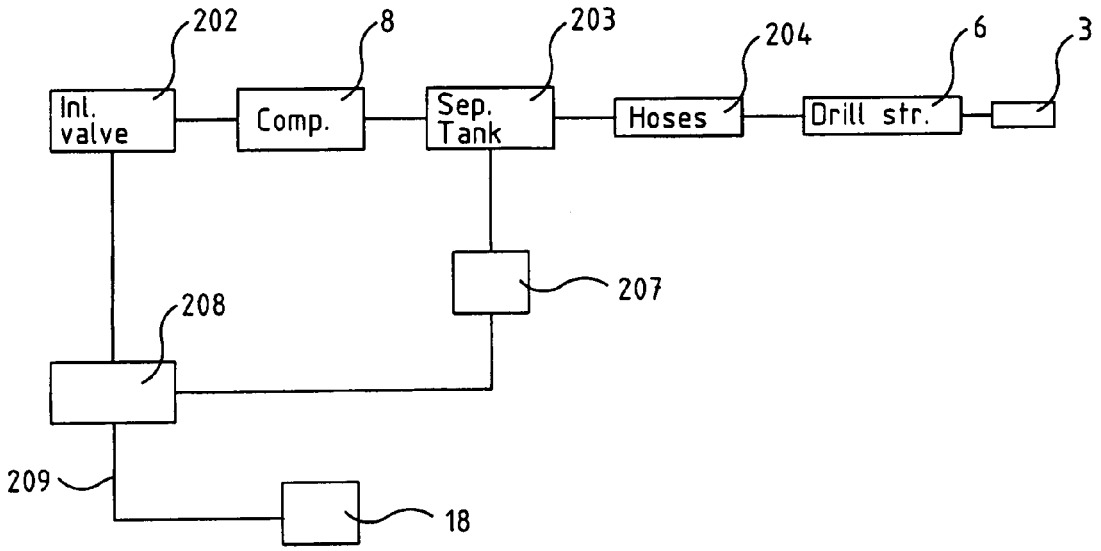
FIG. 2 discloses a system for determining a variation in flushing air flow according to an exemplary embodiment of the present invention.

The present invention solves this by determining a representation of a rate at which a pressure variation is occurring in the flushing medium circuit, where this rate is used to determine if a clogging of the drill bit is about to arise. The present invention is exemplified in FIG. 2. FIG. 2 shows the compressor 8 with inlet valve 202. The figure also shows a compressor tank/separator tank 203, to which a pressure sensor 207 is connected. The pressure sensor 207 is arranged to deliver signals to a control unit 208.

The flow that is supplied to the tank 203 from the compressor 8 is then led via tubes 204 and the drill string 6 to the drill bit 3 for evacuation of drill cuttings. Instead of, as in the solution shown in FIG. 3, control the compressor based on a reference pressure, the pressure according to the embodiment shown in FIG. 2 is controlled based on a reference flow 209.

The reference flow 209, can, for example, be obtained from another part of the rig control system, such as, for example, the control unit 18 which controls percussion force, feed force and rotation etc. during drilling. The reference flow can, for example, be determined by calculations in a control unit 18, where current hole depth, hole diameter etc. can be used at the determination.

The control unit 208 then controls, based on the obtained reference flow, the flow of the compressor 8 according to the above by controlling the inlet valve 202 or by controlling the rotation speed of the compressor, e.g. by controlling the speed of the combustion engine, and according to a further embodiment according to the above described parallel application "METHOD AND SYSTEM FOR CONTROLLING A COMPRESSOR AT A ROCK DRILLING APPARATUS". The control unit 208 consists of a digital control unit, which consequently receives a digital signal that represents the reference flow. By controlling the compressor 8 based on a reference flow it will consequently also be known which flow that is discharged by the compressor 8 at all times. This means that the pressure that arises in the flushing air circuit completely will depend on current flow resistance, which, as has been described above, can vary, e.g. with the number of drill rods.

Instead of, as in the prior art, using a venturi tube when detecting stops in the flushing air flow, only the pressure sensor 207 and the fact that the flow discharged by the compressor is known is used by the present invention.

According to the known continuity equation the following is valid at a given volume:

$$q_{in} - q_{ut} = \frac{dV}{dt} + \frac{V}{\beta_e}\frac{dp}{dt} \qquad \text{(eq. 1)}$$

where:

$q_{in}$ is the flow from the compressor, which is known according to the above;

$q_{ut}$ is the flow out from the drill bit;

$\beta_e$ is the compressibility modulus of the air. The compressibility modulus depends on the physical properties of the air and can vary somewhat in dependence of the kind of compression process being performed in the control volume (isothermic, adiabatic or a combination of the two). This source of errors can, however, with good approximation be considered negligible. In case higher accuracy is required the air temperature after the compressor can be determined, e.g. by means of a temperatured sensor, whereby this temperature can be used to correct for this variation.

In a system according to FIG. 2, the volume V consists of the volume that is determined by the system between the outlet of the compressor up to the drill bit, i.e. essentially the compressor tank and flushing air hoses and drill string between tank and percussion mechanism. In practice, the volume V will vary somewhat with current oil level in the compressor tank (normally this is between a defined minimum and maximum value) and number of drill rods and the diameter of the flushing air channel in the drill rods.

According to one embodiment, therefore, the diameter of the flushing air channel is input into the control system of the rock drilling apparatus so that this diameter can be taken into consideration. Likewise the system can be arranged to keep track of the number of drill rods in the drill string, so that also this volume change can be taken into consideration during ongoing drilling. It is also possible to use a level sensor in the separator tank to take varying oil levels into consideration.

This volume change, however is not continuous, but occurs, for example very slowly in regard of oil level, whereby the volume correction, if a correction at all is carried out, can be performed with relatively long intervals, such that once an hour or day. Likewise, the volume change of the drill string occurs when changing the number of drill rods, which occurs when the drilling is stopped.

Consequently no continuous calculation of $$\frac{dV}{dt}$$

must be performed when applying eq. 1 above. In one embodiment the volume can even be considered constant during the drilling. Since the absolutely largest part of the total volume V will consist of the compressor tank, variations according to the above can many times with good approximation be considered negligible, and the volume V be considered constant. Apart from the compressor tank, the largest volume of the system consists of flushing air hoses between compressor and drill string, and since these parts have a constant volume they can advantageously be comprised in the volume being considered constant. In both cases above eq. 1 can consequently be reduced to eq. 2 below:

$$q_{in} - q_{ut} = \frac{V}{\beta_e}\frac{dp}{dt} \qquad \text{(eq. 2)}$$

where V possibly can be changed e.g. when changing the number of drill rods according to the above, but, from a calculation point of view, also be considered constant.

The unknowns of eq. 2 consequently consists of the flow out of the drill bit $q_{ut}$, and $$\frac{dp}{dt}.$$

Figure 4:
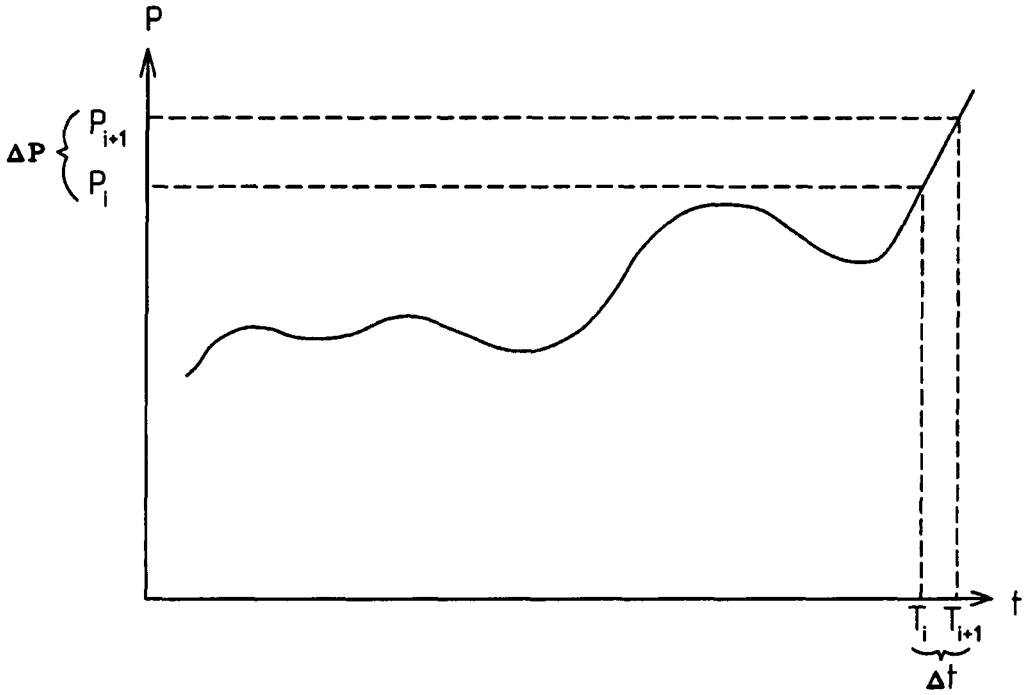
FIG. 4 discloses the pressure variation in time of the flushing medium flow.
Figure 5:
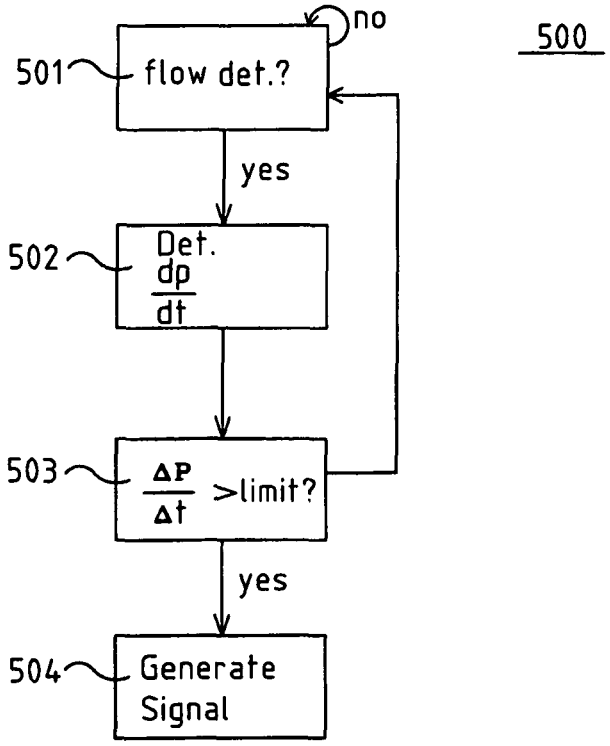
FIG. 5 discloses a flow chart of an exemplary method according to the present invention.

An exemplary method 500 for determining a flow variation according to the present invention is shown in FIG. 5 and starts in step 501, where it is determined if a flow determination is to be carried out, which, for example, can be arranged to be carried out if the compressor and/or flushing is started. In step 502

$$\frac{dp}{dt}$$

is determined, i.e. the velocity (derivative) of the pressure variation. The rate (derivative) of the pressure variation is determined according to the present invention by means of consecutive measurements from pressure sensor 207. This is exemplified in FIG. 4, which shows the variation of the pressure in time, as measured by the pressure sensor 207. The calculation is exemplified for two arbitrary consecutive measurements, where the pressure $P_i$ and $P_{i+1}$, respectively, is obtained at times $t_i$ and $t_{i+1}$ respectively. The derivative $$\frac{dp}{dt}$$

can consequently be determined as $$\frac{P_{i+1} - P_i}{t_{i+1} - t_i},$$

i.e.

$$\frac{\Delta P}{\Delta t}.$$

By performing the said determination, for example with Δt intervals, the variation of the derivative can be followed. Alternatively another suitable way of determining the derivative can be used.

Further, as is realized, eq. 2 means that if the pressure derivative is larger than zero the flow out through the drill bit is less than the amount of air supplied by the compressor, which indicates that the drill bit is clogging. With knowledge of $$\frac{dp}{dt}$$

it is consequently possible to continuously calculate the relation of $q_{in}$—$q_{ut}$, i.e. how the flow out through the drill bit relates to flow out from the compressor. As soon as $$\frac{dp}{dt} > 0$$

$$q_{ut} < q_{in},$$

i.e. the flow out from the drill bit is smaller than the flow out from the compressor. This is an indication that clogging is about to occur. Many times, smaller cloggings can occur which then directly are taken care of solely by the flushing medium flow, whereby $$\frac{dp}{dt}$$

again decreases, for which reason a limit value is used according to the present invention to determine if serious clogging is about to occur. Consequently, if the pressure derivative $$\frac{\Delta P}{\Delta t}$$

becomes too large, this means that the drill bit is about to get clogged. In step 503, therefore, $$\frac{\Delta P}{\Delta t}$$

is compared to a limit value $$\frac{\Delta P}{\Delta t}$$

limit, and if $$\frac{\Delta P}{\Delta t}$$

exceeds the limit value $$\frac{\Delta P}{\Delta t}$$

limit, a signal is generated in step 504 to notify the operator of the drilling rig and/or the control system of the drilling rig that clogging is about to occur. The operator and/or the control system can then take suitable actions to solve problems with ongoing clogging, where methods are well described in the prior art, and which can be used herein. For example, percussion pressure and feed pressure can be reduced or completely shut off to give the flushing air system a possibility to recover.

Otherwise the method returns to step 501.

According to the present invention, consequently, flow variations (flow reductions) can quickly be determined by determining the rate at which the pressure in the system is varying (i.e. the variation of the derivative of the pressure).

The maximum pressure derivative (that arises when the drill bit becomes completely clogged) depends on the amount of flushing air that is supplied, i.e. the compressor flow. For this reason it can be advantageous that the limit value of the pressure derivative $$\frac{\Delta P}{\Delta t}$$

limit depends on the actual compressor flow and/or pressure on the high pressure side of the compressor (such as, for example, the pressure determined by the pressure meter 207).

The above mentioned limit value consequently must not be fixed during the drilling process.

Further, the limit value can, for example, be set such that it corresponds to a situation when the flow out through the flushing air holes in the drill bit has decreased to, for example, 70% or 50% or any other suitable portion of the output flow of the compressor.

The system can also be arranged to avoid "false" indications of clogging, e.g. clogging situations of very short duration that are solved completely by means of the flushing air flow.

In this case, the system can be arranged such that $$\frac{dp}{dt}$$

must exceed the limit value during a certain time, e.g. a half second, a second or by any other suitable time interval.

According to one exemplary embodiment the following expression is used to determine if clogging occurs:

$$\frac{dp}{dt} > \frac{1}{\text{const}} * \text{q_Flush} * \text{p_derivative_max},$$

where const consists of a constant, q_Flush consists of a desired flow quantity in percentage of maximum flow, and p_derivative_max consists of a maximum pressure increase rate that is considered to be possible to occur in the system. The maximum pressure increase rate depends primarily on the maximum flow capacity of the compressor and the volume of the system.

In case the solution of FIG. 2 works in a pressure controlled mode, e.g. due to the compressor having reached the maximum allowed working pressure, the above described monitoring of the flow is carried out in another way. In this mode of operation the compressor works pressure controlled, whereby the system strives to maintain a constant secondary pressure, which means that $$\frac{dp}{dt} = 0.$$

Consequently it is enough to monitor the flow from the compressor since eq. 2 in this case is reduced to $q_{in}=q_{ut}$ where $q_{in}$ can be obtained directly from the compressor control. When $q_{in}$ falls below a given limit, a warning signal is generated according to the above.

The above described monitoring of the flow can further be arranged to be delayed by some suitable time period, e.g. at start up of the system, to avoid the transients that often occur precisely when flushing is activated.

In one embodiment the second derivative is also taken into consideration in some situations, such as when starting the system. The second derivative describes the acceleration of the pressure increase, and can be used to determine if an ongoing pressure increase, for example, depends on the system just having been started, and the pressure thereby is increasing towards a working pressure and not increasing due to clogging. Even if a pressure increase is occurring, and even if the rate of the pressure increase still is increasing, the rate at which the rate of the pressure increase is increasing, i.e. the acceleration, can be decreasing, which can be used as indication that there is no ongoing clogging, at least for as long as the acceleration is considered together with the pressure increase to ensure that the pressure increase is still going on.

The present invention has been exemplified above at a flow controlled compressor. The compressor, however, can also be controlled in another way, whereby the flow discharged by the compressor can be determined by means of, for example, a flow meter, e.g. on the high pressure side of the compressor. The invention can also be used in other kinds of drilling methods than the above exemplified, such as, for example during DTH (Down-The-Hole) drilling.

The invention claimed is:

1. Method for determining a variation of a flushing medium flow at a rock drilling apparatus, where a compressor (8; 301) discharges a flow of pressurized gas, where said gas flow at least partially is used as flushing medium during drilling with a tool (3), wherein, during drilling, said flushing medium is led to said tool (3) for flushing away drilling remnants, the method including the steps of:

determining a rate of pressure variation representing a difference between a flow discharged by the compressor for use as flushing medium and an actual flow of said flushing medium at the tool, and generating a signal of decreased flow of flushing medium at the tool when said determined rate exceeds a first value.

2. Method according to claim 1, wherein said signal is generated first when said determined rate has exceeded said first value during a first time.

3. Method according to claim 2, wherein said determination of said rate of a pressure variation is determined by means of consecutive pressure determinations, where said rate is determined according to $$\frac{\Delta P}{\Delta t},$$

where ΔP is the pressure difference between the pressure determinations and Δt is the time between the pressure determinations.

4. Method according to claim 2, wherein said determination of said rate of a pressure variation is determined by determining a derivative of the pressure variation of said flushing medium.

5. Method according to claim 2, wherein said compressor (8; 301) is controlled such that a determined gas flow is discharged.

6. Method according to claim 1, wherein said determination of said rate of a pressure variation is determined by means of consecutive pressure determinations, where said rate is determined according to $$\frac{\Delta P}{\Delta t},$$

where ΔP is the pressure difference between the pressure determinations and Δt is the time between the pressure determinations.

7. Method according to claim 1, wherein said determination of said rate of a pressure variation is determined by determining a derivative of the pressure variation of said flushing medium.

8. Method according to claim 1, wherein said compressor (8; 301) is controlled such that a determined gas flow is discharged.

9. Method according to claim 8, wherein said compressor flow is controlled by speed control and/or control of the inlet valve (302) of the compressor (8; 301).

10. Method according to claim 1, wherein said determination of a rate of a pressure variation of said flushing medium is performed by means of a determination of a pressure variation on the high pressure side of said compressor (8; 301).

11. Method according to claim 1, wherein said determination of a rate of a pressure variation of said flushing medium is performed by means of a determination of a pressure variation at a position between said compressor (8; 301) and said tool (3).

12. Method according to claim 1, wherein said determination of a rate of a pressure variation is performed continuously or by, certain intervals.

13. Method according to claim 1, wherein, during drilling, said first value is determined at least partially based on the flow discharged by said compressor (8; 301) and/or a pressure on the high pressure side of the compressor (8; 301).

14. Method according to claim 1, further including determining the flow discharged by said compressor (8; 301) by means of a flow meter.

15. Method according to claim 1, wherein said signal is only generated when a second time has lapsed since the drilling started.

16. Method according to claim 1, wherein said determination of a variation of said flushing medium flow consists of a determination of a reduction of a flushing medium flow discharged at said tool (3).

17. Method according to claim 1, wherein, when a maximum set flushing medium pressure has been reached, the flow of the compressor (8; 301) is determined, wherein said signal is generated when said flow is below a second value.

18. Method for determining a variation of a flushing medium flow at a rock drilling apparatus, where a compressor (8; 301) discharges a flow of pressurized gas, where said gas flow at least partially is used as flushing medium during drilling with a tool (3), wherein, during drilling, said flushing medium is led to said tool (3) for flushing away drilling remnants, the method including:

determining a rate of pressure variation of said flushing medium, generating a signal when said determined rate exceeds a first value, and determining a representation of the acceleration (second derivative) of said pressure variation of said flushing medium flow, wherein said signal is only generated when said acceleration exceeds a second value.

19. System for determining a variation of a flushing medium flow at a rock drilling apparatus, where a compressor (8; 301) is arranged to discharge a flow of pressurized gas, where said gas flow at least partially is arranged to be used as flushing medium during drilling with a tool (3), wherein, during drilling, said flushing medium is led to said tool (3) for flushing away drilling remnants, wherein the system includes:

first determination means for determining a rate of a pressure variation representing a difference between a flow discharged from the compressor for use as a flushing medium and an actual flow of said flushing medium at the tool, and signal generating means for generating a signal of decreased flow of flushing medium at the tool when said determined rate exceeds a first value.

20. Rock drilling apparatus, wherein said apparatus includes a system according to claim 19.

* * * * *